United States Patent [19]

Murakami

[11] 4,330,194

[45] May 18, 1982

[54] METHOD OF DRIVING COPY MATERIAL AND PHOTOSENSITIVE MEMBER OF COPYING APPARATUS

[75] Inventor: Kakuji Murakami, Kawasaki, Japan

[73] Assignee: Ricoh Co., Ltd., Japan

[21] Appl. No.: 101,582

[22] Filed: Dec. 10, 1979

[30] Foreign Application Priority Data

Dec. 15, 1978 [JP] Japan ..... 53-154122

[51] Int. Cl.[3] ..... G03G 15/22; B65H 17/18

[52] U.S. Cl. ..... 355/3 R; 355/16; 226/94

[58] Field of Search ..... 226/27, 94; 355/16, 355/3 BE, 3 R

[56] References Cited

U.S. PATENT DOCUMENTS

| | | | |
|---|---|---|---|
| 2,826,408 | 3/1958 | Beveridge et al. | 226/94 |
| 3,493,157 | 2/1970 | Burdorf et al. | 226/94 |
| 3,685,906 | 8/1972 | Raterman | 355/103 |
| 3,936,177 | 2/1976 | Moriyama et al. | 226/94 X |
| 4,110,027 | 8/1978 | Sato et al. | 226/94 X |
| 4,197,970 | 4/1980 | Plumadore | 226/94 |

FOREIGN PATENT DOCUMENTS

| | | | |
|---|---|---|---|
| 930222 | 7/1973 | Canada | 226/94 |
| 7514882 | 8/1976 | Netherlands | 355/3 BE |

*Primary Examiner*—J. V. Truhe
*Assistant Examiner*—Richard M. Moose
*Attorney, Agent, or Firm*—McGlew and Tuttle

[57] ABSTRACT

In superposing a copy web and a photosensitive member one over another and transferring a toner image of the copy web by transfer printing from the photosensitive member carrying a toner image of an original formed by following the steps of charging the photosensitive member, exposing the photosensitive member to an optical image of the original to form an electrostatic latent image thereon and developing the electrostatic latent image, one of the copy web and the photosensitive member is driven and the other is driven by the frictional force and electrostatic attractive force, so that relative movement of the photosensitive member and the copy web can be avoided while they are in contact with one another.

10 Claims, 21 Drawing Figures

METHOD OF DRIVING COPY MATERIAL AND PHOTOSENSITIVE MEMBER OF COPYING APPARATUS

BACKGROUND OF THE INVENTION

This invention relates to a method of synchronously driving a photosensitive member and a copy web in a copying apparatus and an apparatus suitable for carrying such method into practice.

When color duplication of an original in color is carried out by using an electrophotographic copying apparatus of the type in which each of toner images formed on a photosensitive member, by the steps of charging, exposing and developing, is transferred to a copy web, a plurality of toner images of different colors obtained by separating the color of the original, are successively transferred to the copy web to produce a copy of the original in color. In this case, the color of the copy obtained would not match the color of the original if the toner images of different colors were not in register with one another when they are superposed and transferred to the copy sheet. The toner images of different colors are often brought out of register with one another when the movement of the photosensitive member and the movement of the copy web are not in synchronism with one another.

When both the photosensitive member and the copy web are driven to move through a transmission system including gears and chains, the positions in which the gears and chains are brought into meshing engagement with one another would vary, when the pitch of the gears and chains is changed, thereby causing a change in the printing pressure applied to the copy web and the photosensitive member when printing is carried out. Irregularities in backlash caused by a jitter phenomenon or discrepancy in velocity caused by irregularities in the pitch of the gears and chains would render color registry impossible and cause distortion of the printed image or errors in the size of the duplicates to be produced. These phenomenons would have influences on the quality of the copy in color obtained by copying.

When a belt formed of rubber and pulleys are used for driving a photosensitive member and copy web, synchronism is not achieved due to slip of the belt.

SUMMARY OF THE INVENTION

This invention obviates the aforesaid disadvantages of the prior art. Accordingly, the invention has as its object the provision of a method of driving a photosensitive member and copy material in synchronism with each other and an apparatus suitable for carrying the method into practice.

The aforementioned object can be accomplished according to the invention by driving one of the photosensitive member and the copy material or support member of the copy material and frictionally driving the other thereof by electrostatic attraction acting between them.

DESCRIPTION OF THE PREFERRED EMBODIMENTS

Figure 1:
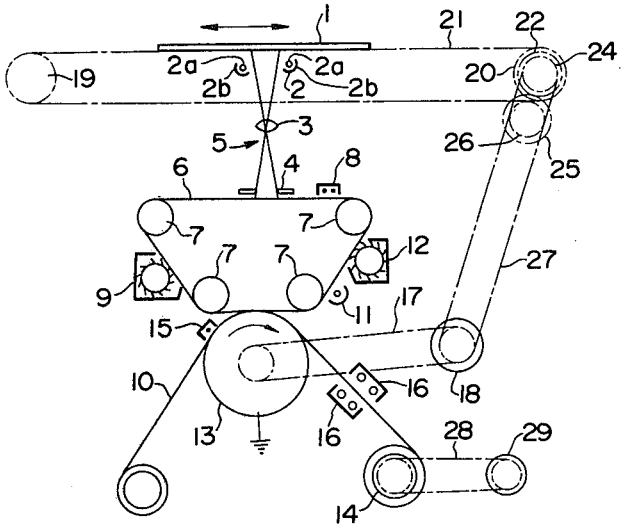
FIG. 1 is a schematic view in explanation of a copying apparatus using the driving method according to the invention.

Preferred embodiments of the invention will now be described by referring to the accompanying drawings. Referring to FIG. 1, an original placed on an original support deck 1 is irradiated by irradiation means 2 comprising a lamp 2*a* and a reflecting plate 2*a*. The light emitted by the lamp 2*a* is transmitted by optical means 5 comprising a lens 3 and a slit 4 to the surface of a photosensitive member 6 to form thereon an electrostatic latent image from an optical image of the original by exposing.

Figure 2:
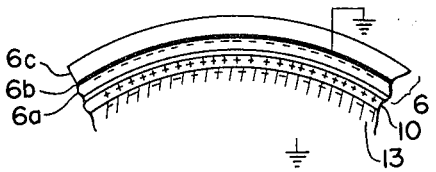
FIG. 2 is a schematic view in explanation of portions of the photosensitive member, copy web and copy web support member brought into contact with one another.

As shown in FIG. 2, the photosensitive member 6 consists of a photoconductive material layer 6*a*, a conductive material layer 6*b* and a backing layer 6*c*, and may, for example, be in the form of a flexible endless belt trained over a plurality of rollers 7. For example, the photoconductive material layer 6*a* may be formed of polyvinyl carbazol having its sensitivity increased with a dye, the conductive material layer 6*b* of aluminum in a layer of below 1$\mu$ in thickness, and the backing layer 6*c* of polyester film.

As in ordinary electrophotographic copying apparatus, the photosensitive member 6 is for example positively charged as by a corona charger 8 while in motion and exposed to an optical image of the original by the optical means 5 to form thereon an electrostatic latent image of the original which is developed into a visible image by means of a developer 9 with negatively charged toner.

The visible image formed by toner on the photosensitive member 6 is printed on a web of copy material 10 by transfer printing. After having the toner image printed on the web of copy material 10, the photosensitive member 6 has the electric charge removed by a charge removing lamp 11 and cleaned by cleaning means 12. Then the photosensitive member 6 is subjected to another cycle of copying.

The web of copy material 10 has an insulating property, and when the web is used as film for use with an overhead projector or transparent film for projection after being printed, it may be advantageously formed of material selected from the group of high polymers consisting of polyester, cellulose acetate, polyimide, polycarbonate, polyvinyl chloride, polyethylene, polypropylene and polystylene. When the web of copy material 10 may be opaque, the material may be any one of the aforesaid high polymers added with a white pigment, such as zinc oxide, titanium oxide, clay, calcium carbonate or barium sulfate. Also, the web may be formed of a film of any one of the aforesaid high polymers having applied to its surface a white pigment together with a binder, such as polyacrylic acid ester, polyvinyl butyral, polyvinyl acetate, epoxy resin, alkyd resin or silicone resin, or plain paper coated which is given an insulating property.

Referring to FIG. 1 again, the web of copy material 10 is in roll form and wound on a takeup roll 14 after being payed out and brought into contact with a web support drum 13.

After being payed out of the roll, the web of copy material 10 is charged by a corona charger 15 oppositely to the toner of a developer 9 or positively, for example, and moves to a printing position.

In the printing position, the web of copy material 10 is brought into contact with the photosensitive member 6 and supported by the web support drum 13, which is grounded, in such a manner that the web 10 and member 6 overlap one another in a certain region thereof.

While the photosensitive member 6 and the web of copy material 10 are maintained in contact with one another in the printing position, the negatively charged toner image on the photosensitive member 6 is attracted to the positively charged web of copy material 10 of insulating property, so that the former is printed on the latter by transfer printing.

The web of copy material 10 of insulating property having an image printed thereon is passed through fixing means 16, which may be an infrared heater, for example, before being wound on the takeup roll 14, to have the image fixed.

In the prior art, the web of copy material and the photosensitive member have each been driven through a transmission by a motor. In the present invention, however, the manner in which the photosensitive member and the web of copy material are driven is distinct from that of the prior art. In the embodiment shown in FIG. 1, the photosensitive member 6 is merely trained over the rotatable rollers 7 without having any drive force exerted thereon. The web support drum 13 is driven by a motor 18 through a transmission 17, such as a chain, for example.

The original support deck 1 which should be moved in synchronism with the photosensitive member 6 is fixed to a carriage wire 21 trained over pulleys 19 and 20. The pulley 20 is connected to a gear 22 and further connected to a chain wheel 24 through an electromagnetic clutch, not shown.

In meshing engagement with the gear 22 is a clutch gear 25 which is connected to a reversing wheel 26 through an electromagnetic clutch, not shown. A chain 27 is trained over the chain wheel 24, the reversing wheel 26 and a chain wheel attached to an output shaft of the motor 18.

Actuation of the motor 18 rotates the web support drum 13, and the original support deck 1 is also driven by the motor 18 through the chain 27 to move in the directions of arrows in synchronism with the rotation of the web support drum 13.

As the electromagnetic clutches are engaged and disengaged in predetermined timed sequence, the original support deck 1 moves in reciprocatory movement in the directions of arrows with the original support deck 1 being moved in the forward direction by the rotation of the motor 18 transmitted through the chain wheel 24, electromagnetic clutch and pulley 20 and in the rearward direction by the rotation of the motor 18 transmitted through the reversing wheel 26, electromagnetic clutch, clutch gear 25, gear 22 and pulley 20, while the chain 27 is driven to run in one direction.

The web takeup roll 14 is connected to a torque motor 29 through a transmission 28, such as a chain, for example. The torque motor 29 performs the function of avoiding slackening of the web of copy material 10 as the latter is released from the support drum 13 and moves to the takeup roll 14.

As the web support drum 13 rotates, the web of copy material 10 is electrostatically attracted to the web support drum 13 and frictionally moved. At this time, an electrostatic attracting force acts between the photosensitive member 6 and the web of copy material 10 in portions thereof which are in contact with one another, so that the photosensitive member 6 is attracted to the web of copy material 10 and moves therewith. When the insulated web of copy material 10 charged positively and the photosensitive sheet 6 charged positively are superposed one over the other as shown in FIG. 2, a negative charge is induced in the conductive material layer **6*b* of the photosensitive member 6 and a strong attracting force acts between the photosensitive member 6 and the web of copy material 10 having insulating property. The frictional force produced by the electrostatic attracting force and acting between the photosensitive member 6 and the web of copy material 10** can be expressed as follows:

$$P = \frac{\epsilon_o \, d\mu}{t\epsilon_T + d\epsilon_p} \times \left(\frac{\epsilon_T}{d}\right)^2 abv^2 \qquad (1)$$

where

P: Frictional force (N) acting between web of copy material and photosensitive member.

$\epsilon_o$: Dielectric constant of vacuum (F/m).

$\epsilon_T$: Specific dielectric constant of web of copy material.

$\epsilon_p$: Specific dielectric constant of photoconductive material.

d: Thickness (m) of web of copy material.

t: Thickness (m) of photoconductive material layer.

$\mu$: Coeffecient of static friction between web of copy material and photosensitive member.

a: Width of overlapped portions of web of copy material and photosensitive member.

b: Length of overlapped portions of web of copy material and photosensitive member.

v: Surface potential (v) of web of copy material when charged prior to overlapping.

As is clear in the theoretical equation, the force of the electrostatic attraction for moving the photosensitve member 6 may vary depending on the area of the overlapped portions of the photosensitive member 6 and the web of copy material 10 and the magnitude of the surface potential of the web of copy material produced by charging, so long as the same photosensitive member and web of copy material are used.

Figure 3:
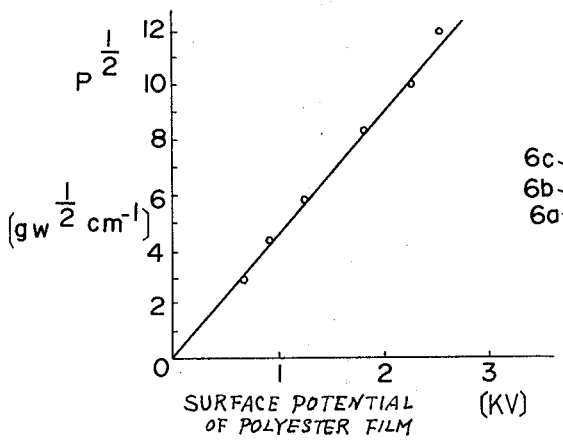
FIG. 3 is a graph showing a frictional force in relation to the surface potential of the copy web.

FIG. 3 shows the results of experiments conducted on the web of copy material 10 and the photosensitive material 6 to measure the frictional force acting between them by using a polyester film of 75$\mu$ in thickness as the web of copy material 10 and a photoconductive material layer of polyvinyl carbazol of 15$\mu$ in thickness in the photosensitive member 6.

In the diagram shown in the figure, the ordinate represents the value of a square root $P^{\frac{1}{2}}(gw^{\frac{1}{2}}\cdot cm^{-1})$ of the frictional force per unit area and the abscissa indicates the surface potential (KV) of the web of copy material 10.

When the overlapped portions of the web of copy material 10 and the photosensitive member 6 had a width of 25 cm and a length of 15 cm and charging was effected to produce a surface potential of 2500 V on the web of copy material, the frictional force was about 47 Kg which was high enough to move the photosensitive member 6 without causing it to slip.

To enable the invention to achieve the desired effects, it is essential that the torque of the torque motor 29 be smaller than the frictional force produced by the electrostatic attraction acting between the web support drum 13 and the web of copy material 10. The torque motor 29 has no influence on the rate of feeding of the web of copy material 10 which is determined by the linear velocity of the web support drum 13.

In the embodiment shown in FIG. 1, the web of copy material 10 is preliminarily charged before the photosensitive member 6 is superposed thereon. In this embodiment, the corona charger 15 may be eliminated and a bias voltage may be impressed on the web support drum 13, to cause the electrostatic attraction to act between the photosensitive member 6 and the web of copy material 10. In this case, the electrostatic attraction is proportional to the square of the impressed voltage.

Figure 4:
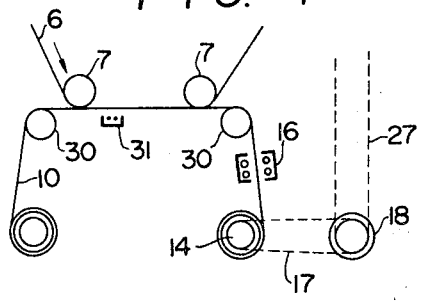
FIGS. 4–6 and FIGS. 9, 11, 12 and 13 are schematic views in explanation of modifications of the copying apparatus shown in FIG. 1.

FIG. 4 shows another embodiment in which the web of copy material 10 is trained over two web support rollers 30, instead of one web support drum 13 as shown in FIG. 1 and the web of copy material 10 is brought into contact with the photosensitive member 6 in a portion of the run thereof disposed between the two rollers 30. In this embodiment, a transfer-printing corona discharger 31 is used to produce an electric field between the web of copy material 10 and the photosensitive member 6 to effect transfer printing of the toner image from the photosensitive member 6 to the web of copy material 10. The charge carried on the undersurface of the web of copy material 10 produced an electrostatic attraction between the web of copy material 10 and the photosensitive member 6 which is utilized to frictionally move the photosensitive member 6 by the web of copy material 10.

In the embodiment shown in FIG. 4, the takeup roll 14 is driven by the motor 18, although the web support rollers 30 may be driven instead. In the figure, parts similar to those shown in FIG. 1 are designated by like reference characters and description thereof is omitted therefor and, as well, for the other embodiments hereinafter to be described.

Figure 5:
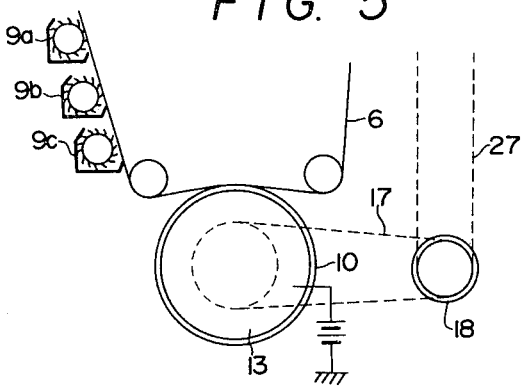

FIG. 5 shows an embodiment which is incorporated in a color copying apparatus, wherein the web of copy material is wound on the web support drum 13 on which a bias voltage is impressed to print a toner on the web of copy material 10 by transfer printing from the photosensitive member 6.

The photosensitive member 6 is exposed to optical images of the original in color separated into primary colors by the optical means 5 to form electrostatic latent images thereon which are succesively developed by portions 9*a*, 9*b* and 9*c* of the developer 9 having colors corresponding to the primary colors, to produce toner images in three different colors. The toner images in three colors on the photosensitive member 6 are printed by transfer printing on the web of copy material 10 in such a manner that one toner image in one color is printed while the web support drum 13 makes one complete revolution. Thus, the toner images in three different colors formed on the photosensitive member 6 by the action of the developer 9 are printed in superposed relation on the web of copy material 10 as the web support drum 13 makes three complete revolutions. By setting the exposing of the photosensitive member 6 to optical images of three different colors and developing of the optical images in three different colors in correctly timed sequence with respect to the circumferential length of the web support drum 13, it is possible to produce on the web of copy material 10 a desired toner image in color by driving the photosensitive member 6 with a frictional force developed by electrostatic attraction acting between the photosensitive member 6 and the web of copy material 10. Since the web 10 and member 6 are driven in synchronism with one another, the final toner image in color obtained in this way is free from the defect of the colors being out of register.

Since the web of copy material 10 and the photosensitive member 6 are driven in synchronism, the transmission for the drive means has only to take into consideration timing of the feeding of the web of copy material 10 with the feeding of the original.

In the embodiments shown in FIGS. 1–5, the web of copy material 10 is driven and the photosensitive member 6 is moved by the frictional force. It is to be understood, however, that the invention is not limited to this specific arrangement and that the photosensitive member 6 may be driven and the web of copy material 10 may be moved by the frictional force.

Figure 6:
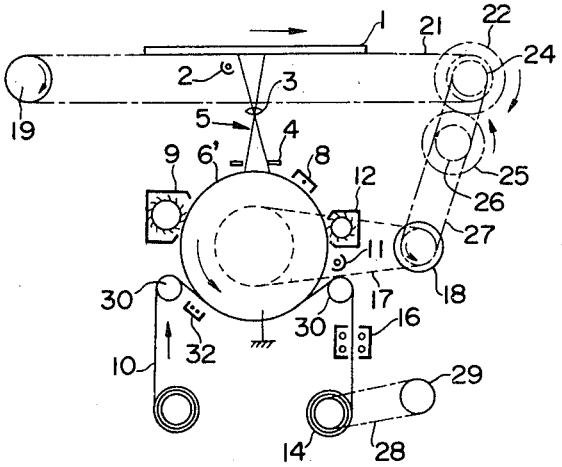
Figure 7:
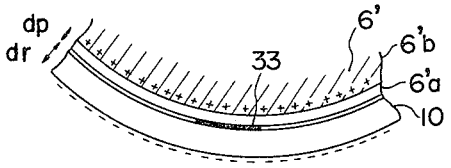
FIG. 7 is a schematic view in explanation of portions of the photosensitive member and copy web of the embodiment shown in FIG. 6 disposed in contact with each other.

In the embodiment shown in FIG. 6, the photosensitive member is in the form of a drum 6' in which, as shown in FIG. 7, a photoconductive material layer 6'*a* is formed on the surface of a conductive drum substrate 6'*b*. The conductive drum substrate 6'*b* may be formed of aluminum, iron or other metal, and the photoconductive material layer 6'*a* may be formed of selenium, selenium-tellurium or other inorganic compound or polyvinyl carbazol, anthracene or other organic compound. The photoconductive material layer 6'*a* may have a dielectric material layer thereon.

The photosensitive drum 6' including a photosensitive layer formed on an aluminum drum by using a photoconductive compound, such as polyvinyl carbazol-trinitrofluorenone complex, is charged by the corona charger 8 so that the surface potential will be about −800 V, and exposed to an optical image by the optical means 5. The latent image on the drum is then developed by the developer 9 using a positively charged toner.

The web of copy material 10 trained over the web support rolls 30 is brought into contact with the photosensitive drum 6' holding with the aforesaid toner image, and the toner image on the photosensitive drum 6' is printed by transfer printing on the web of copy material 10 by means of a transfer-printing corona charger 32.

In the embodiment shown in FIG. 6, the photosensitive drum 6' is rotated in a direction opposite to the direction of rotation of the web support drum 13 shown in FIG. 1, so that the motor 18 in FIG. 6 rotates in a direction opposite to the direction of rotation of the motor 18 in FIG. 1. Thus in this embodiment, the electromagnetic clutches for effecting reciprocatory movement of the original support deck 1 are engaged and disengaged in a manner opposite to the manner in which they are engaged and disengaged in the embodiment shown in FIG. 1. Other parts in FIG. 6 similar to those shown in FIG. 1 are designated by like reference characters and operate in like manner.

At the time the web of copy material 10 is brought into contact with the photosensitive drum 6', a negative charge is induced in the web of copy material 10 and a positive charge is induced on the conductive material layer of the photosensitive drum 6', for example, by the corona charger 32, as shown in FIG. 7. Thus a positive toner image 33 on the photosensitive drum 6' is printed on the web of copy material 10 by transfer printing. At the same time, electrostatic attraction acts between the photosensitive drum 6' and the web of copy material 10.

A frictional force is caused to act between the photosensitive drum 6' and the web of copy material 10 by the electrostatic attraction acting between them. The frictional force can be expressed as follows:

$$P\alpha \frac{\mu ab V^2}{\left(\frac{dp}{\epsilon_p} + \frac{d_T}{\epsilon_T}\right)^2} \quad (2)$$

where $d_p$: Thickness of photoconductive material layer of photosensitive drum.

$d_T$: Thickness of web of copy material.

v: Surface potential of web of copy material in contact with photosensitive drum following transfer printing effected by corona charger.

Other notations are similar to those used in equation (1).

The relation between the voltage impressed on the wires of the transfer-printing corona charger 32 and the surface potential v of the web of copy material 10 can be expressed by the following formula:

$$v = C - K \quad (3)$$

where

C: the voltage impressed on wires.

K: Constant.

From equations (2) and (3), it will be seen that the force which drives the web of copy material 10 by electrostatic attraction may vary depending on the coefficient of friction between the photosensitive drum and the web of copy material, the area of the overlapped portions of the photosensitive drum and the web of copy material, the thickness of the web of copy material, the thickness of the photoconductive material layer of photosensitive drum, and the voltage impressed on the wires of the charger.

Figure 8:
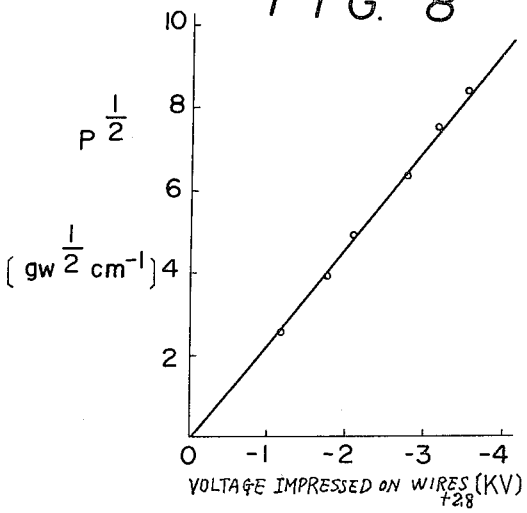
FIG. 8 is a graph showing the frictional force in relation to a voltage applied on the wires of the charger in the embodiment shown in FIG. 6.

FIG. 8 shows the results of experiments conducted on the photosensitive drum and the web of copy material to determine the frictional force produced between them. In the experiments, the web of copy sheet was in the form of a film of polyester having a thickness of 75μ, and the photosensitive drum was provided with a photoconductive material layer of about 10μ in thickness formed by applying material containing a polyvinyl carbazoltrinitrofluorenol complex as its chief ingredient. In the diagram shown in FIG. 8, the ordinate represents the value of $P^{\frac{1}{2}}$, and the abscissa indicates summation of the value (Kv) of the voltage imressed on the wires of the charger and 2.8.

When the overlapped portions of the photosensitive drum and the web of copy material had a width of 25 cm and a length of 15 cm and the voltage impressed on the wires of the charger was −6 Kv, the frictional force produced was about 21 Kg which was high enough to move the web of copy material.

Figure 10:
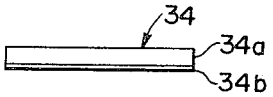
FIG. 10 is a schematic view in explanation of the construction of the copy web support member of the embodiment shown in FIG. 9.
Figure 9:
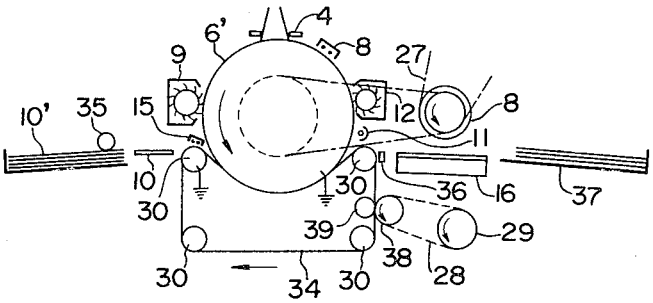

A modification of the embodiment shown in FIG. 6 is shown in FIG. 9 in which a copy sheet support member 34 in the form of an endless belt including an insulating film **34*a* and a conductive material layer 34*b* (see FIG. 10) is used in place of the web of copy material 10 shown in FIG. 6 and trained over the support rollers 30 as shown in FIG. 9. The copy web support member 34 is brought into contact with the photosensitive drum 6' in the same manner as described by referring to FIG. 6**.

A copy sheet 10' of plain paper is fed by a sheet feeding roller 35 between the copy sheet support member 34 in the form of an endless belt and the photosensitive drum 6'.

The copy sheet support member 34 in the form of an endless belt may be constructed such that the insulating film **34*a* is a polyester film and the conductive material layer 34*b* formed of aluminum deposited on one side of the insulating film 34*a* by vaporization deposition in vacuum to have a thickness of about 1μ. The conductive material layer 34*b* is grounded by the support rollers 30** which are also grounded.

The copy sheet support member 34 is subjected to preliminary charging by the corona charger 15 after the copy sheet 10' fed by the sheet feeding roller 35 is superposed on the member 34. The toner image formed on the photosensitive drum 6' in the same manner as described by referring to FIGS. 1–6 is printed on the copy sheet 10' by transfer printing when the preliminarily charged copy sheet 10' is brought into contact with the photosensitive drum 6'.

If the copy sheet 10' has a low electrical resistance, then the electrostatic attraction is weak. When this is the case, the occurence of slip can be avoided by increasing the width of the copy sheet support member 34 and photosensitive drum 6' to thereby increase the area of the overlapped portions.

The copy sheet 10' conveyed by the copy sheet support member 34 following separation from the photosensitive drum 6' after having a toner image printed thereon is removed from the copy sheet support member 34 by a sheet removing member 36, has its image fixed by the fixing means 16, and is delivered to a copy tray 37.

A pair of feed rollers, such as a feed roller 38 and a rubber roller 39, may be provided for holding the copy sheet support member 34 therebetween, as an ancillary drive means which functions before the copy sheet support member 34 is frictionally driven by the photosensitive drum 6' by virtue of the electrostatic attraction acting between the photosensitive drum 6' and the copy sheet support member 34. The feed roller 36 is driven by the torque motor 29 through the chain. In this embodiment, only one portion of the copy sheet 10' and the copy sheet support member 34 is charged by the charger 15 and no electrostatic attraction acts between the photosensitive drum 6' and the copy sheet support member 34 until the charged portion is brought into contact with the photosensitive drum 6'. Thus the frictional force is low and there is the possibilities of slip occurring between the copy sheet support member 34 and the photosensitive drum 6'. The torque motor 29 performs the function of avoiding the occurrence of slip between the copy sheet support member 34 and the photosensitive drum 6' before electrostatic attraction acts therebetween as when the apparatus is started. Thus the torque motor 29 serves as an auxiliary drive means or tension control means.

Figure 11:
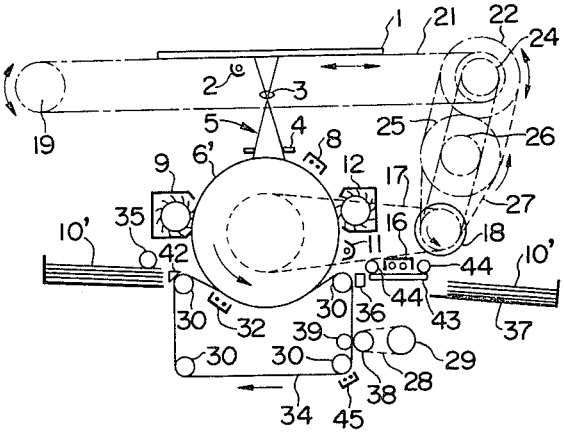

In the embodiment shown in FIG. 11, charging by the corona charger 32 is effected in a position in which the copy sheet support member 34 commences its contact with the photosensitive drum 6'. Even in this case, an auxiliary drive means, such as the torque motor 29, may sometimes be necessary.

In the embodiment shown in FIG. 11, it is only in a portion of the copy sheet support member 34 and the photosensitive drum 6' disposed immediately below the corona charger 32 that electrostatic attraction acts, when the apparatus is started. The electrostatic attraction acting at the time of starting of the apparatus may vary in force depending on the shape of the corona charger 32 and the voltage impressed on the wires of thereof. The smaller the area of the overlapped portions of the charged copy sheet 34 and the photosensitive drum 6', the smaller is the frictional force, thereby causing slip to occur. Thus it is necessary to drive the copy sheet support member 34 by the torque motor 29 through the pair of rollers 38 and 39 until the charged zone of the copy sheet support member 34 becomes large enough to enable the photosensitive drum 6' to drive the copy sheet support member 34 by frictional dragging due to the electrostatic attraction without the occurrence of slip. By using this auxiliary drive means, it is possible to avoid the occurrence of slip between the photosensitive drum 6' and the copy sheet support member 34.

Figure 12:
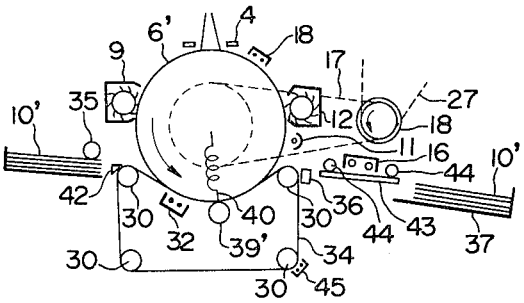

In place of the pair of rollers 38 and 39 driven by the torque motor 29 as shown in FIG. 11, the auxiliary drive maeans may comprise a feed rubber roller 39' for forcing the copy sheet support member 34 against the photosensitive drum 6' by the biasing force of a spring 40 as shown in FIG. 12. In FIG. 12, the feed roller 39' forces the copy sheet support member 34 against the photosensitive drum, so that the copy sheet support member 34 is driven by a frictional force as the photosensitive drum 6' is driven by the motor 18. When the overlapped portions of the charged zone of the insulated copy sheet support member 34 and the photosensitive drum 6' have become sufficiently large in area to permit the photosensitive drum 6' to drive the copy sheet support member 34 by a frictional force of electrostatic attraction without developing slip, the feed rubber roller 39' is released from contact with the copy sheet support member 34 by means, not shown, such as a cam or a solenoid. If the biasing force of the spring 40 is low as compared with the electrostatic attraction acting between the photosensitive drum 6' and the copy sheet support member 34 and if the direction in which the copy sheet support member 34 is fed not influence by the rotation of the rubber roller 39', then no problem is raised. However, if the feed rubber roller 39' is kept in pressing contact with the copy sheet support member 34 when the biasing force of the spring 40 is substantially equal to the electrostatic attraction, synchronous movement of the photosensitive drum 6' and the copy sheet support member 34 holding the copy sheet therebetween may be adversely affected by eccentricity of the rubber roller 39', eccentricity of the photosensitive drum 6' and a lack of parallelism between the photosensitive drum 6' and the rubber roller 39'.

Figure 13:
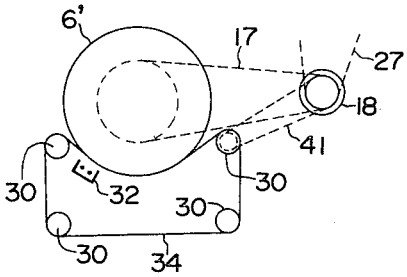

In place of the auxiliary drive means relying on the torque motor 29 shown in FIG. 11, a construction may be used in which one of the web support roller 30 for supporting the web support member 34 is driven by the motor 18 through a chain 41 as shown in FIG. 13. By this arrangement, it is possible to drive the copy sheet support member 34 by means of the motor 18 through a clutch mounted between the support roller 30 and the motor 18 and intermittently engaged and disengaged, to thereby drive the copy sheet support member 34 during the time the frictional force acting between the member 34 photosensitive drum 6' by electrostatic attraction is still not enough for driving the member 34. The driving of the member 34 by this auxiliary means can be stopped when the frictional force has become high enough to drive the member 34.

In FIGS. 11 and 12, there is shown a modification of the embodiment in which a copy sheet 10' is delivered by a guide 42 to the copy sheet support member 34 and a copy sheet separated from the member 34 has its image fixed by the fixing means 16, while being moved by a guide 43 and a sheet ejecting roller 44, before being ejected onto the copy tray 37. The copy sheet support member 34 has its charge removed by a charge removing corona discharger 45 after the copy sheet is separated therefrom and charged again by the charger 32 in a cycle while being frictionally driven.

Figure 14:
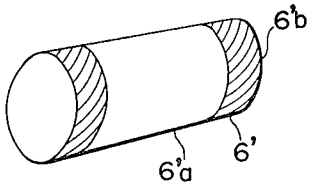
FIG. 14 is a perspective view of a modification of the photosensitive drum of the embodiment shown in FIG. 11.

In the construction shown in FIGS. 11 and 12 wherein the insulating copy sheet support member is brought into contact with the photosensitive member and a charge is given by a corona charger to the two members from the underside of the copy sheet support member to drive one of the two members by the frictional force produced by electrostatic attraction due to the charge given to the two members, it is advantageous to use as the photosensitive member a photosensitive drum 6' having, as shown in FIG. 14 a photoconductive material layer **6'*a* in a portion of the surface of the drum which is necessary for forming an image and a conductive material layer 6'*b* in the rest of the surface of the drum. In a copying apparatus provided with the construction shown in FIGS. 11 and 12, if the copy sheets used have an insulating property, the electrostatic attraction acting between the photosensitive member and the copy sheet will be relatively strong and slip will rarely occur. However, if the copy sheets are plain paper or other material of relatively low electrical resistance, the electrostatic attraction will be weak and slip will tend to occur. In this case, the occurrence of slip can be eliminated if the photosensitive member and the copy sheet support member are increased in width and the area of the overlapped portions of the photosensitive member and the copy sheet support member having no copy sheet held therebetween is increased so that corona charging can be effected from the underside of the overlapped portion of the copy sheet support member. Generally, corona charging effected when the copy sheet support member and the conductive material layer of the photosensitive member are directly in intimate contact with each other can give stronger electrostatic attraction than corona charging effected when the copy sheet support member is in intimate contact with the photoconductive material layer over the conductive material layer of the photosensitive member. When the photosensitive drum shown in FIG. 14** is used and corona charging is effected from the underside of the copy sheet support member in intimate contact with the conductive material layer of the photosensitive member, the frictional force acting between them can be expressed by the following equation:

$$P=(\epsilon_r\epsilon_o/d^2)abV^2 \quad (4)$$

where $\epsilon_o$: Dielectric constant of vacuum (F/m)

$\epsilon_r$: Specific dielectric constant of copy sheet support member d: Thickness of copy sheet support member (m)

Figure 16:
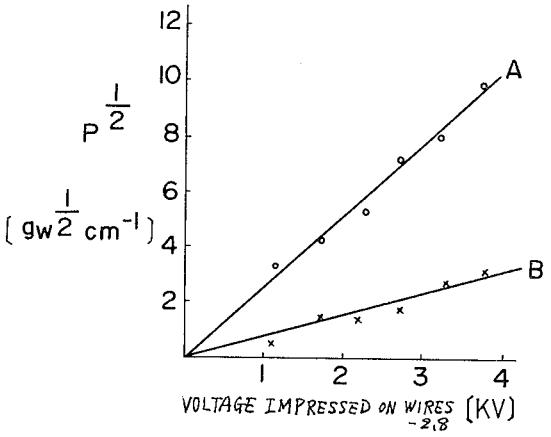
FIG. 16 is a graph showing the frictional force of the embodiment shown in FIG. 11 using the photosensitive drum of FIG. 14 in relation to a voltage applied on the charger

FIG. 16 shows a comparison of the frictional force produced when the copy sheet support member is directly in intimate contact with the conductive material layer of the photosensitive member as corona charging is effected with the frictional force produced when the copy sheet support member is in intimate contact with the photoconductive material layer of the photosensitive member as corona chargins is effected. The straight line A in the diagram shown in FIG. 16 represents a static frictional force produced when a polyester film of 100$\mu$ in thickness serving as the copy sheet support member was brought into contact with an aluminum drum having a surface subjected to sand mat working and serving as the photosensitive member and corona charging was effected from the underside of the copy sheet support member. A straight line B represents a static frictional force produced when the same copy sheet support member was brought into contact with the surface of the photosensitive member having a photoconductive material layer or a layer of selenium-tellurium of a thickness of about 50$\mu$ and corona charging was effected in like manner. In the diagram in FIG. 16 in which the corona charging is not positive, the abscissa represents the voltage impressed on the wires minus 2.8 Kv, and the ordinate indicates the value of $P^{\frac{1}{2}}$. A higher frictional force generally produced when the copy sheet support member is directly in contact with the conductive material layer of the photosensitive member would stem from the fact that the electrostatic attraction is increased by the absence of the photoconductive material layer. It is also possible to increase the frictional force by coarsening the surface of the conductive material layer to increase its coefficient of friction. By using the photosensitive drum as shown in FIG. 14, it is possible to cause strong electrostatic attraction to act between the photosensitive member and the copy sheet support member to thereby produce a sufficiently high frictional force for driving the copy sheet support member.

Figure 15:
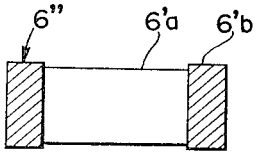
FIG. 15 is a front view of another modification of the photosensitive drum.

When a copy sheet is held between the copy sheet support member and the photosensitive drum shown in FIG. 14, a gap corresponding to the thickness of the copy sheet is formed between the copy sheet support member and the photosensitive drum and the electrostatic attraction is accordingly reduced. FIG. 15 shows a modification of the photosensitive drum shown in FIG. 14, wherein photoconductive material layer 6'a has a diameter smaller than that of opposite end portions of the drum in which the conductive substrate of the photosensitive drum is exposed by an amount corresponding to the thickness of the copy sheet. The use of the photosensitive drum 6'' shown in FIG. 15 enables the conductive substrate of the photosensitive drum to be brought into intimate contact with the copy sheet support member at all times regardless of whether a copy sheet is held therebetween, thereby permitting strong electrostatic attraction to act between the photosensitive member and the copy sheet support member.

When an elongated photosensitive member is driven by bringing a portion thereof into intimate contact with a rotating drum as in the driving device shown in FIG. 1, it is necessary that the axis of the drum is at right angles to the edges of the photosensitive member. In actual practice, however, difficulties are encountered in maintaining the photosensitive member and the drum in the described relative positions due to a lack precision of working and assembly. When the photosensitive member and the drum are not in the described relative positions, the photosensitive member gradually deviates from its normal course of movement during operation and moves sideways.

Figure 17:
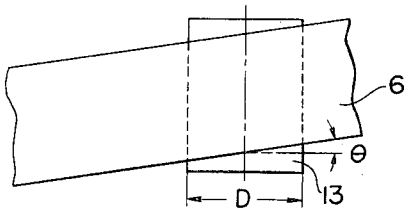
FIGS. 17 and 18 are views in explanation of lateral displacements of the photosensitive member.

Let us assume that, as shown in FIG. 17, the photosensitive member 6 has its edge form an angle $\theta$ with a line at right angles to the axis of the drum 13. If the photosensitive member 6 is driven by the frictional force or electrostatic attraction applied by the drum 13, the photosensitive member 6 will deviate from its normal course of movement and tend to move sideways. When the amount of feed of the photosensitive member 6 is x, the sideways movement of thereof is $y=x \tan \theta$.

Figure 18:
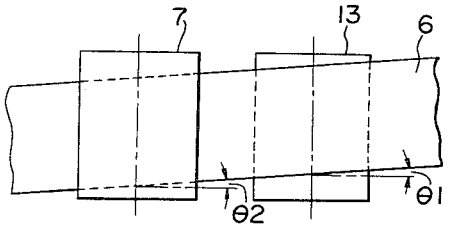

FIG. 18 shows an arrangement whereby the photosensitive member 6 is trained over more than two drums or the web support drum 13 and at least one roller 7. If the angles formed by the edge of the photosensitive member 6 with a line at right angles to the axis of the drum 13 are denoted by $\theta 1$ and $\theta 2$, the amount of the sideways movement of the photosensitive member 6 will have a difference of $\Delta y=x (\tan \theta 1-\tan \theta 2)$ between the two drums. When this difference in the amount of the sideways movement is caused by the drums over which the photosensitive member is trained, the photosensitive member tends to move in zigzag motion or become wrinkled.

To avoid the occurrence of zigzag motion of the photosensitive member or the production of wrinkles therein, it is at least necessary that the angles $\theta 1$ and $\theta 2$ be equal to each other. This can be achieved only when the axes of the drums are completely parallel one another.

If the allowable deviation in color is 0.1 mm in color copying, it is necessary that the parallel movement be below $0.1/2\pi D$. This critical value will be 1/25,000 when the diameter of the drum D is 400 mm.

Moreover, in order to avoid the occurrence of zigzag movement or wrinkle formation, it is necessary that the drums be of true cylindrical shape and no slackening or elongation of the photosensitive member occur.

In actual practice, however, difficulties are encountered in obtaining a parallelism of whithin 1/25,000 and in producing drums of true cylindrical shape while avoiding the photosensitive member becoming loosened or elongated. This makes it necessary to provide means for preventing a difference from occurring in sideways displacements of the photosensitive member without trying to bring the angles $\theta 1$ and $\theta 2$ into arrangement with one another.

When the photosensitive member is driven as by rollers the point of contact of the photosensitive member with any one of the rollers will be gradually displaced sideways as the rollers rotates if the photosensitive member is inclined relative to the particular one of the rollers, thereby increasing the sideways displacement of the photosensitive member. By taking this phenomenon into consideration, attempts were made to render stationary some of the rollers that serves as guide means for the photosensitive member so that the photosensitive member slides on the surfaces of the rollers serving as stationary guide means, with excellent results.

Figure 19:
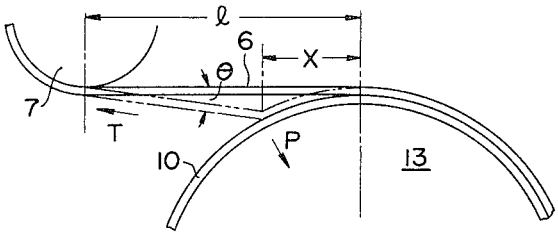
FIGS. 19 and 20 are views in explanation of the manner in which wrinkles are formed when attraction is effected, FIG. 19 being a side view and FIG. 20 being a plane view.
Figure 20:
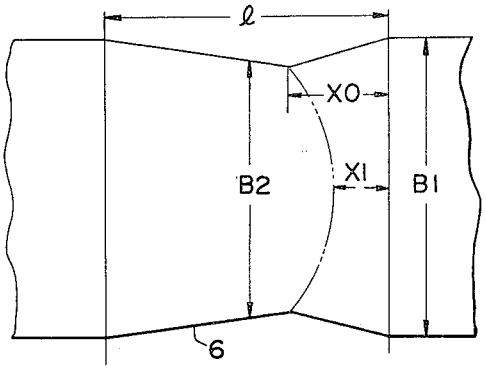

In driving the photosensitive member by the frictional force produced by electrostatic attraction, the photosensitive member 6 is electrostatically attracted to the web of copy material 10 wrapped around the web support drum 13 as the drum rotates. Electrostatic attraction begins to act, as shown by dash-and-dot lines in FIG. 19, in a position located anterior to the theoretical point of contact for a length X with respect to the direction of movement of the photosensitive member 6. Thus the photosensitive member 6 interposed between the roller 7 and drum 13 is rather drawn toward the drum 13 than stretching straight and evenly contacted by the roller 7 and drum 13, so that a portion of the member 6 between the point at which electrostatic attraction actually begins to act and the point at which electrostatic attraction theoretically begins to act is unexpectedly brought into contact with the drum 13. As a result, the width of the photosensitive member 6 is slightly reduced as shown in FIG. 20 and the portion of the member 6 unexpectedly brought into contact with the drum 13 differs in length from the center to the marginal portions. For example, as shown in FIG. 20, the central portion has a length $X_1$ which differs from the length $X_0$ of the marginal portions.

Generally, $X_0 > X_1$ and the width B1 of the portion of the photosensitive member 6 which is unexpectedly brought into contact with the drum 13 and the width B2 of the narrowest portion of the member 6 differ from one another.

When the difference between B1 and B2 is over 0.5 mm, the photosensitive member 6 tends to be wrinkled as it is electrostatically attracted to web support drum 13. To minimize the chances of wrinkle formation, it is necessary to minimize the difference between B1 and B2. To minimize the difference between B1 and B2, it is necessary to minimize the difference between $X_0$ and $X_1$ in the length of the portion of the member 6 unexpectedly brought into contact with the drum 13. To this end, one has only to minimize the length X of the portion of the photosensitive member 6 between its actual and theoritical points of contact with the drum 13 which is unexpectedly brought into contact with the drum 13 in FIG. 19 by electrostatic attraction P.

The length X of the portion of the member 6 is determined by the electrostatic attraction P and the tension T acting on the photosensitive member 6.

If the distance between the theoretical point of contact of the photosensitive member 6 with the web support drum 13 and the point of contact between the photosensitive element 6 and the roller 7 located anterior to the drum 13 is denoted by l, the relation $(l-x)$ $\tan\theta = KT \sin\theta \approx (P/2)$ holds. Since $\tan\theta \approx \sin\theta$, $l-x = K\,T$ where K is the proportional constant.

Since the length l is determined by design, it is necessary to maximize the tension T exerted on the photosensitive member in order to minimize the length X of the photosensitive member unexpectedly brought into contact with the drum 13.

With the tension exerted on the photosensitive member 6 increased more than is necessary, elongation of the photosensitive member 6 results and it is impossible to provide uniform elongation to the whole of the photosensitive member. Thus, local variations occur in the elongation of the photosensitive member 6. Elongation of the photosensitive member 6 is not desirable, particularly when variations occur locally in the elongation, because deviation of the image in color occurs when the image is printed by transfer printing on the web of copy material from the photosensitive member, thereby causing a distortion in the image produced. Thus there are limits to the tension applied to the photosensitive member.

The tension exerted on the photosensitive member is preferably as small as possible from the point of view of minimizing elongation of the photosensitive member, and preferably as large as possible from the point of view of avoiding wrinkle formation in the photosensitive member by electrostatic attraction. When one considers the problem of how to reduce the length X of the portion of the photosensitive member unexpectedly brought into contact with the web support drum while meeting the aforesaid conflicting requirements concerning the tension exerted on the photosensitive member, one finds that the distance l betweeen the points of contact of the photosensitive member plays an important part.

The results of tests show that if the distance l is selected in such a manner that it is within 1/6 the diameter of the web support drum 13 which attracts the photosensitive member 6 and drives same by the frictional force, no wrinkles are formed in the photosensitive member 6 by using as the tension T a tension usually exerted on the photosensitive member 6 in the art.

In driving a photosensitive member, it is necessary to exert tension on the photosensitive member. It has hitherto been usual practice to apply the brake to the photosensitive member so as to exert tension on the photosensitive member between it and the drum for moving it by frictional force. Methods used for applying the brake to the photosensitive member include a method consisting in applying a photosensitive member roll for feeding the photosensitive member, and a method consisting in rotating a guide roller in a direction opposite to the direction of movement of the photosensitive member to thereby apply the brake to the photosensitive member by frictional force. These methods have, however, had the disadvantage that the photosensitive member is greatly elongated in a position in which tension is exerted thereon, thereby causing local elongation to occur in the photosensitive member. This is a factor concerned in the development of variations in the elongation of the photosensitive member from one portion to another, thereby causing deviation in color of the image produced and reducing the quality of the copy.

It has been ascertained that as means for tensioning the photosensitive member by gradually exerting a frictional force thereon, the use of fixed guide means having a curved surface or circularly arcuate surface to move the photosensitive member while keeping same in pressing contact with the arcuate surface of the guide can achieve excellent effects. More specifically, a frictional force is produced as the photosensitive member contacts the arcuated surface of the guide and resistance is gradually offered to the movement of the photosensitive member so that the tension exerted on the photosensitive member gradually increased as the area of contact increase and is maximized on the surface thereof which is brought into contact with the web support drum. Thus, the use of the aforesaid fixed guide offers the advantage that a predetermined tension can be exerted on the photosensitive member without exerting tension abruptly thereon as when the sharp brake is applied or a reversing roller is used.

Figure 21:
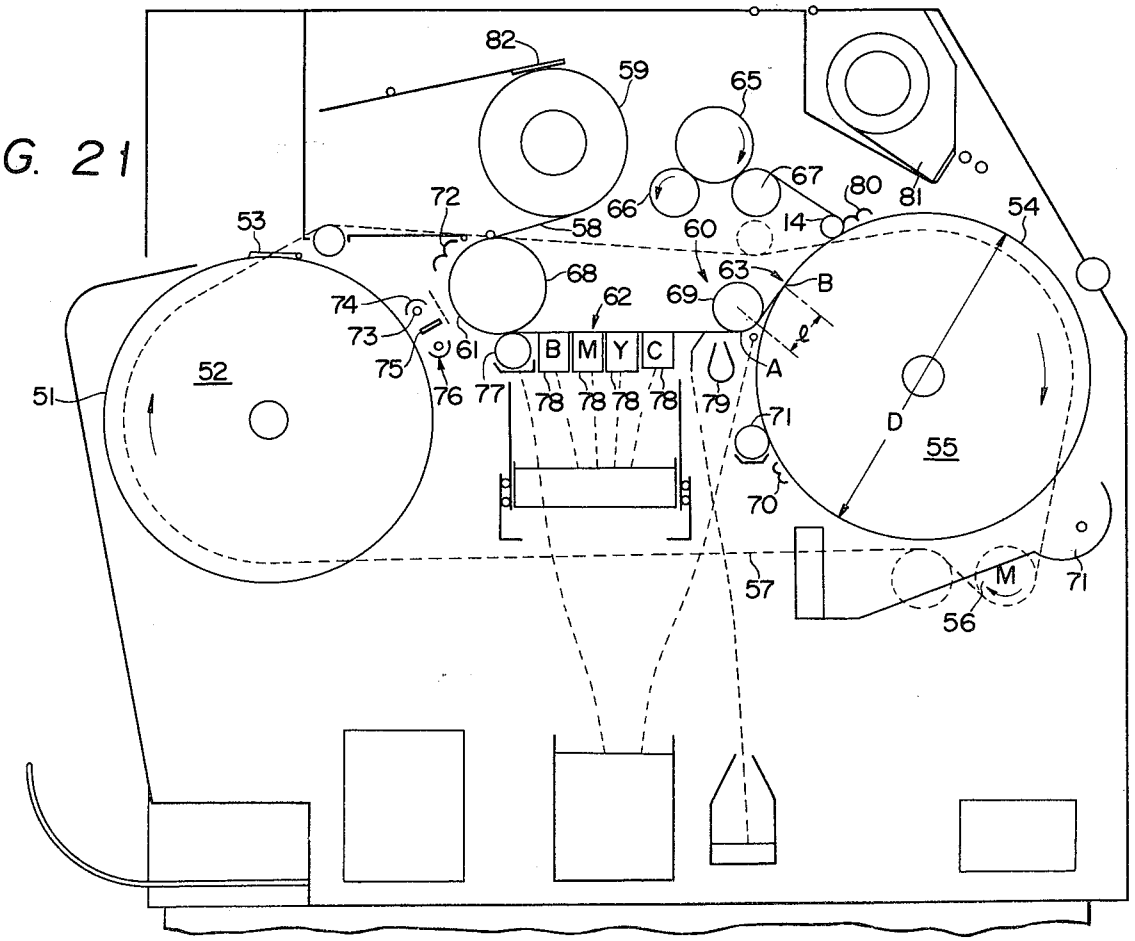
FIG. 21 is a view in explanation of the copying apparatus using a modification of the drive means according to the invention.

In the embodiment shown in FIG. 21, an original 51 is secured to an original support drum 52 by fastening means 53 and a copy sheet 54 for forming thereon a duplicate image of the original is secured to a copy sheet drive drum 55 of the same diameter as the original support drum 52.

The original support drum 52 and copy sheet drive drum 55 are rotated at the same peripheral velocity by a motor 56 through motive power transmitting means 57. The motive power transmitting means 57 is shown as being in the form of an endless belt. Other suitable means, such as a chain, may be used in place of the endless belt.

A photosensitive member 58 is withdrawn from a photosensitive member roll 59 and moved by drive means 60 to a transfer-printing position 63 on the copy sheet drive drum 55 after travelling through an exposing position 61 and a developing position 62. From the transfer-printing position 63, the photosensitive member 58 is delivered to a takeup roll 65 by a pickup roller 64, to be wound on the takeup roll 65 supported by a drive roller 64 and a support roller 67 and frictionally driven by the drive roller 66.

Drive means 60 comprises a first fixed guide 68 of the cylindrical shape, a second fixed guide 69 of the cylindrical shape, and the drive drum 55 charged by a charger 70 and preliminary wetted by a pre-wetting roller 71 with a solution of the same type as the developing agent.

The photosensitive member 58 adheres by electrostatic attraction to the charged drive drum 55 to be driven by the latter as it rotates.

While being driven, the photosensitive member 58 is charged by a charger 72 and exposed in the exposing position 61 to an optical image of the original in one of four different colors produced by decomposition of the color of the original by exposing means 76 comprising a lamp 74, a reflector 74 and optical means 75, to form an electrostatic latent image thereon. Then the photosensitive member 58 is wetted preliminarily by a prewetting roller 77 with the same solution as the developing agent, is developed by one of four developers 78 for cyanine, yellow, magenta and black in accordance with the color selected in decomposing the color of the original, has excess developing agent removed by squeezing means 79, and is brought into contact with the copy sheet 54. The image on the photosensitive member 58 is printed by transfer printing on the copy sheet 54 while the photosensitive member 58 is driven by the rotating copy sheet drive drum 55 while being kept in contact with the copy sheet 54.

After transfer printing is effected, the photosensitive member 58 is separated from the copy sheet 54 under the action of a charge remover 80 and picked up by the pickup roller 64, be wound on the takeup roll 65. The copy sheet 54 having an image printed thereon has the image fixed by fixing means 81 following drying, and the aforesaid series of operations of exposing and developing is repeated for each of the different colors with the copy sheet 54, to produce copy having an image in color of the original.

After being released from the photosensitive member roll 59, the photosensitive member 58 is passed around the arcuate surfaces of the first fixed guide 68 and second fixed guide 69 so that the photosensitive member 58 moves in sliding movement and is driven by frictional force applied thereto by the curved surfaces of the fixed guides 68 and 69 with which the member 58 is brought into contact.

Since the photosensitive member 58 moves in sliding movement while contacting the fixed guides 68 and 69, there are no possibilities of sideways movement of the photosensitive member 58 which would otherwise occur if there is no true parallelism between the fixed guides 68 and 69. Also, by suitably selecting the circumferential extents of the fixed guides 68 and 69 for the photosensitive member 58 to be passed therearound, it is possible to select a desired tension exerted on the photosensitive member 58. If the structural relation of the fixed guides 68 and 69 is such that a predetermined tension is not exerted on the photosensitive member 58 by the use of the fixed guides 68 and 69 alone, it is possible to increase the tension exerted on the photosensitive member 58 by applying the brake to the photosensitive member drum 59 by means of a brake 82.

The use of the fixed guides 68 and 69 of the cylindrical shape having circularly arcuate surfaces makes it possible to avoid high tension being locally exerted on the photosensitive member and elongation of the photosensitive member 58 markedly occurring locally therein.

The distance l between a point A at which the photosensitive member 58 is released from contact with the second fixed guide 69 and a point B at which it is brought into contact with the copy sheet drive drum 55 is selected to be below 1/6 the diameter D of the drum 55. This permits formation of wrinkles in the photosensitive member 58 to be positively avoided.

The present invention enables the sideways movement or elongation of the photosensitive member to be avoided so that the trouble of colors being out of register can be eliminated in duplicating an original in color. The invention also prevents formation of wrinkles in the photosensitive member due to electrostatic attraction so that a copy in color of high quality can be produced, particularly when the original is large in size.

What is claimed is:

1. A method of driving a copy material and a photosensitive member of a copying apparatus wherein the photosensitive member has a toner image of an original arranged thereon which is formed by charging, exposing and developing, and wherein the copy material is fed to a transfer position in which the copy material is brought into contact with the photosensitive member to receive the toner image from the photosensitive member, such method comprising the step of:

driving one of the photosensitive member and the copy material through a transmission;

contacting the photosensitive member with the copy material at the transfer position;

applying a bias voltage between the photosensitive member and the copy material to form an electrostatic force between the photosensitive member and the copy material; and driving both the photosensitive member and the copy material in synchronism by driving the other one of the photosensitive member and the copy material by the electrostatic attractive force.

2. A method as claimed in claim 1, wherein said electrostatic attractive force is so large that a frictional force produced between said photosensitive member and copy material causes no slip to occur between them.

3. A method as claimed in claim 2, wherein the copy material is formed in a web.

4. A method as claimed in claim 2, wherein said bias voltage is applied with corona discharger.

5. A method as claimed in claim 2, wherein said copy material is fed by a support member.

6. A method as claimed in claim 5, further comprising the step of additionally driving the other one of the photosensitive member and the copy material support member by auxiliary drive means while one of them is driven until the frictional drive force produced between them by the electrostatic attraction reaches a level at which the occurrence of slip can be avoided.

7. A method as claimed in claim 5, further comprising the step of additionally driving the other one of the photosensitive member and the copy material support member by auxiliary drive means while one of them is driven by a motor, said auxiliary drive means producing a drive force smaller than the frictional force produced by the electrostatic attraction acting between the photosensitive member and the copy material.

8. A method as claimed in claim 5, wherein the photosensitive member includes a photoconductive layer formed on a conductive material and is constructed to have the conductive areas on the surface of marginal portions, the copy material support member fees the copy material on the surface thereof and is brought into contact with the marginal conductive portions of the photosensitive member, thereby transferring the toner image from photosensitive member to the copy material and simultaneously conveying said photosensitive member and copy material support member by force by electrostatic attraction.

9. A method as claimed in claim 8, wherein the copy material support member is made of an electrically insulating material and is formed in an endless belt.

10. A method as claimed in claim 9, wherein the corona charge is applied to the back side of the copy material support member.

* * * * *